US009202621B2

(12) United States Patent
Wild

(10) Patent No.: US 9,202,621 B2
(45) Date of Patent: Dec. 1, 2015

(54) SLOTTED BOBBIN MAGNETIC COMPONENT DEVICES AND METHODS

(71) Applicant: Power-One, Inc., Camarillo, CA (US)

(72) Inventor: Urs Wild, Bäretswil (CH)

(73) Assignee: Power-One, Inc., Camarillo, CA (US)

( * ) Notice: Subject to any disclaimer, the term of this patent is extended or adjusted under 35 U.S.C. 154(b) by 126 days.

(21) Appl. No.: 14/078,428

(22) Filed: Nov. 12, 2013

(65) Prior Publication Data

US 2014/0184378 A1 Jul. 3, 2014

Related U.S. Application Data

(63) Continuation-in-part of application No. 13/669,060, filed on Nov. 5, 2012, now abandoned.

(60) Provisional application No. 61/555,361, filed on Nov. 3, 2011.

(51) Int. Cl.

| | |
|---|---|
| ***H01F 27/30*** | (2006.01) |
| ***H01F 27/32*** | (2006.01) |
| ***H01F 5/02*** | (2006.01) |

(52) U.S. Cl.

CPC ..... *H01F 27/325* (2013.01); *H01F 5/02* (2013.01); *H01F 27/303* (2013.01)

(58) Field of Classification Search

CPC ..... H01F 27/303
USPC ..... 336/196, 199
See application file for complete search history.

(56) References Cited

U.S. PATENT DOCUMENTS

| | | | | |
|---|---|---|---|---|
| 3,083,930 | A | 4/1963 | Brekke | |
| 4,419,536 | A | 12/1983 | Doyle et al. | |
| 4,473,811 | A | 9/1984 | Schauble | |
| 4,924,200 | A | 5/1990 | Kitahara et al. | |
| 5,010,314 | A | 4/1991 | Estrov | |
| 5,175,525 | A | 12/1992 | Smith | |
| 5,332,989 | A | 7/1994 | Ching | |
| 6,201,463 | B1 | 3/2001 | Yamashita et al. | |
| 6,278,353 | B1 | 8/2001 | Downing et al. | |
| 6,587,023 | B2 | 7/2003 | Miyazaki et al. | |
| 6,853,284 | B2 | 2/2005 | Nagai et al. | |
| 6,856,227 | B2 | 2/2005 | Ushio et al. | |
| 7,236,079 | B2 | 6/2007 | Lin | |
| 7,498,921 | B1 * | 3/2009 | Wang | 336/200 |
| 7,567,164 | B2 | 7/2009 | Chin | |
| 8,179,222 | B2 * | 5/2012 | Lee et al. | 336/208 |
| 8,395,470 | B2 | 3/2013 | Lin | |
| 2007/0241853 | A1 | 10/2007 | Yang et al. | |

* cited by examiner

*Primary Examiner* — Elvin G Enad
*Assistant Examiner* — Ronald Hinson
(74) *Attorney, Agent, or Firm* — Patterson Intellectual Property Law, P.C.; Mark J. Patterson

(57) ABSTRACT

A slotted bobbin magnetic component device includes a bobbin having an elongated bobbin tube with transverse slots. One or more substantially flat electrically conductive winding inserts are inserted radially onto the bobbin tube via the transverse slots. At least one detent positioned on the winding insert secures the winding insert on the bobbin and prevents the winding insert from becoming misplaced relative to the bobbin. One or more flanges protruding from the bobbin engage one or more corresponding recesses on the winding insert to prevent angular movement of the winding insert relative to the bobbin. One or more primary conductive winding coils are disposed about the bobbin in the gaps between adjacent winding inserts, the coils being formed by axially winding numerous layers over each other in alternating axial winding directions.

11 Claims, 20 Drawing Sheets

SLOTTED BOBBIN MAGNETIC COMPONENT DEVICES AND METHODS

CROSS-REFERENCES TO RELATED APPLICATIONS

This application claims benefit of the following patent application(s) which are hereby incorporated by reference: U.S. Provisional Patent Application Ser. No. 61/555,361 filed Nov. 3, 2011 and titled "Intersected Transformer"; and co-pending U.S. patent application Ser. No. 13/699,060 filed Nov. 5, 2012 and titled "Slotted Bobbin Magnetic Component Devices and Methods," all of which are hereby incorporated by reference in their entireties.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic components for electronic circuits and more particularly to magnetic components such as inductors and transformers having a bobbin and one or more windings or coils disposed on the bobbin.

Magnetic components are generally known in the art for use in electronic circuits for various applications such as converting power or voltage. Such components are commonly found in many types of circuits and electronic devices such as power supplies and converters, amplifiers, voltage regulators, etc. Many conventional magnetic components for electronic circuits utilize a bobbin around which one or more conductive windings or coils are positioned. A magnetically permeable core is positioned near the bobbin structure for manipulating or shaping a magnetic field generated when electric current is passed through the one or more conductive windings. In many conventional magnetic components, the core extends into an axial passage in the bobbin on the interior of the winding or coil loops.

Conventional transformer devices generally include a primary winding wrapped a first number of turns around the bobbin, and a second winding wrapped a second number of turns around the same bobbin. Each winding may be associated with different portions of an electronic circuit or alternatively different electronic circuits altogether. By controlling the number of turns and location of each winding, desired performance characteristics of the transformer may be achieved.

One problem with conventional bobbin-wound magnetic components such as transformers that utilize multiple windings is proper positioning of the various coils. Minor variations in winding placement can affect device performance. As such, precision winding configurations are necessary to ensure consistent and reliable performance. However, in many applications, complex magnetic field interactions are desired among the primary and secondary windings. Such magnetic field interactions may be required for example to reduce effects of the magnetic component on surrounding circuit elements or to reduce high frequency effects and power losses. Conventional winding configurations using conductive wires wound around a bobbin may be inadequate for such complex field interactions due in part to problems with wire positioning, wire size, etc.

Another problem associated with conventional magnetic component devices includes movement of planar windings during positioning of one or more wire coils on the bobbin structure between the planar windings. The planar windings may become unintentionally misaligned or may fall out during the coil winding process. Additionally, coil placement between planar windings may cause the planar windings to flex or bow axially, resulting in uneven coil placement.

What is needed then are improvements in the devices and methods for magnetic components and associated bobbin structures for positioning one or more conductive windings.

BRIEF SUMMARY

The present invention provides a slotted bobbin magnetic component and associated subcomponents. In some embodiments, the magnetic component forms an inductor or a transformer.

The magnetic component of the present invention includes a bobbin for positioning one or more conductive windings or coils. The bobbin includes an elongated bobbin tube extending axially along a bobbin axis of elongation. An axial passage is defined inside the bobbin tube along the axis of elongation. One or more magnetically permeable core members may be placed at least partially into the axial passage. One or more slots are defined in the bobbin tube in at least one plane oriented substantially transverse to the axis of elongation of the bobbin tube. A substantially planar or flat conductive winding insert, or winding sheet, is radially installed onto the bobbin tube at the axial location of the transverse slot. A radial winding insert opening defined in the winding insert allows the winding insert to be installed onto the bobbin tube from the radial direction. One or more detent features are located on the winding insert to prevent inadvertent movement of the winding insert relative to the bobbin.

In some embodiments, multiple parallel transverse slots are defined in the bobbin tube, and one or more substantially planar winding inserts are installed in each transverse slot. Insulating spacers may be placed between adjacent winding inserts in some embodiments.

Axial gaps defined between adjacent winding inserts provide a space for installing one more primary winding coils, such as conductive coils of copper wire. Each primary winding coil may include a number of radially-extending turns of wire. In some embodiments, each primary winding coil loop located between adjacent winding inserts includes turns that are axially aligned.

In further embodiments, the present invention includes a bobbin structure for use with a magnetic component. The bobbin includes an axially-extending bobbin tube having a plurality of transverse slots defined therein. Each transverse slot is generally shaped to allow one or more substantially planar winding inserts to be installed radially onto the bobbin tube.

In some embodiments, it is an object of the present invention to provide a winding in multiple sections on a bobbin for improved use of the winding area.

A further object of the present invention is to provide a magnetic component with increased power level without increasing power losses caused by increased proximity effects.

An additional object of the present invention is to provide a bobbin structure with predefined axial locations for positioning winding inserts.

Another object of the present invention is to provide a winding insert having one or more detent structures to radially secure the winding insert on a bobbin.

A further object of the present invention is to provide a winding insert and bobbin having an angular stop to prevent angular movement of the winding insert relative to the bobbin.

Numerous other objects, features and advantages of the present invention will be readily apparent to those skilled in the art upon a reading of the following disclosure when taken in conjunction with the accompanying drawings.

DETAILED DESCRIPTION

Figure 1:
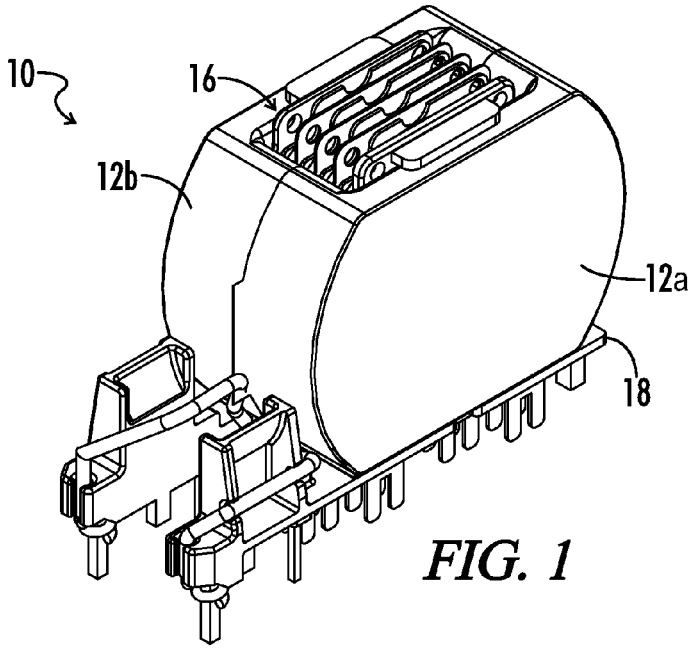
FIG. 1 illustrates a perspective view of an embodiment of a magnetic component in accordance with the present invention.

Referring now to the drawings, FIG. 1 illustrates an embodiment of a magnetic component 10 in accordance with the present invention. Magnetic component 10 includes a bobbin 18 supporting first and second magnetic core halves 12*a*, 12*b*. The core halves 12*a*, 12*b*, may include any conventional type of suitable core such as a standard or modified E-core, EFD core, EVD core, or an I-core in various embodiments.

Figure 2:
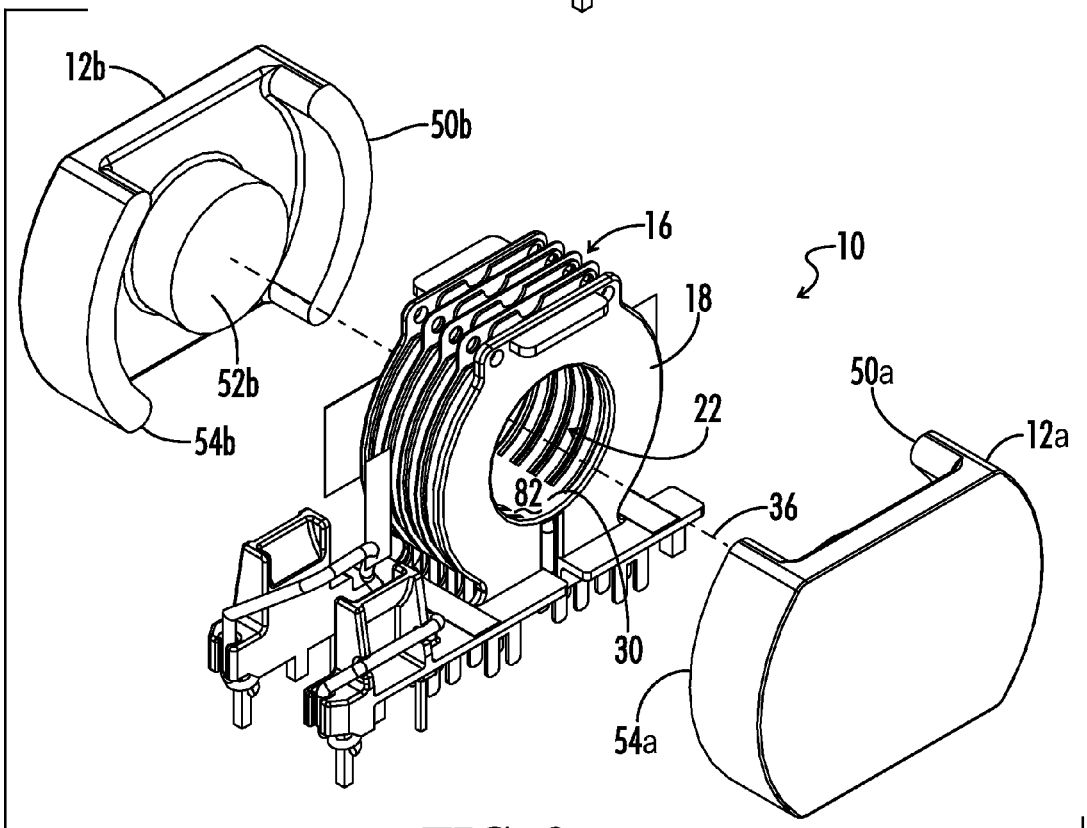
FIG. 2 illustrates a partially exploded view of the embodiment of a magnetic component of FIG. 1.
Figure 5:
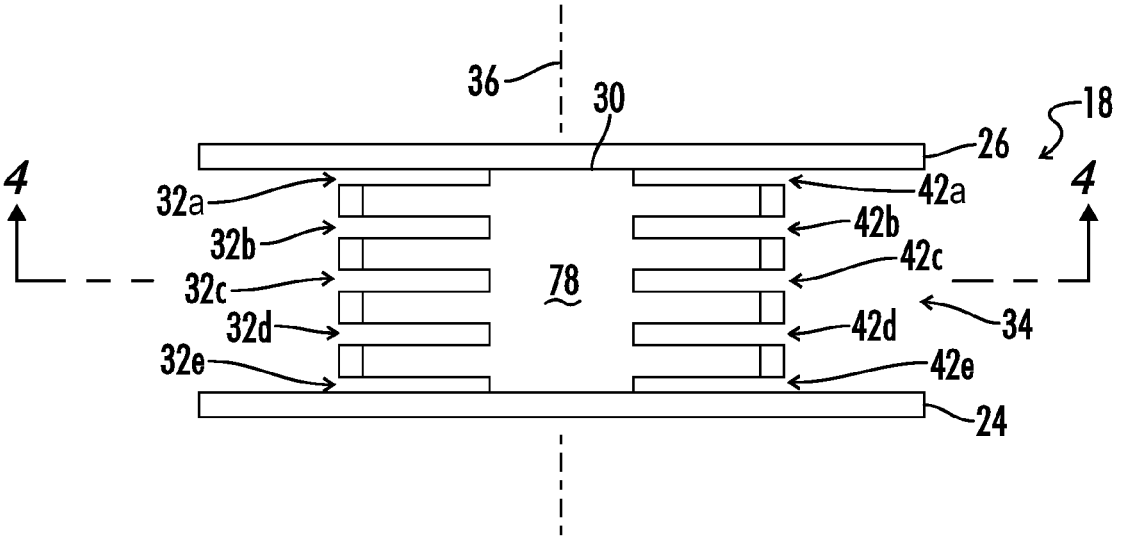
FIG. 5 illustrates a top view of the embodiment of a bobbin of FIG. 4.
Figure 9:
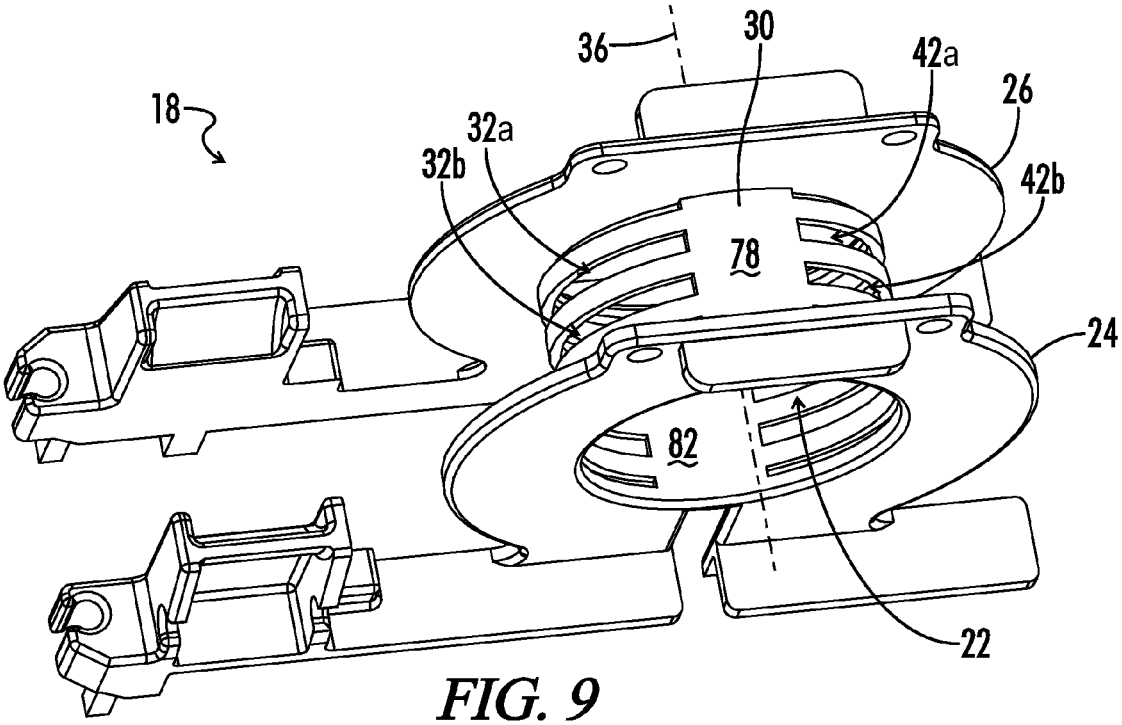
FIG. 9 illustrates a perspective view of an embodiment of a bobbin in accordance with the present invention.

Bobbin 18 includes an elongated bobbin tube 30 extending along an axis of elongation 36, seen in FIG. 5 and FIG. 9. Bobbin tube 30 generally includes an annular shape such that an axial passage 22 is defined along the axis of elongation. Bobbin tube 30 includes a substantially circular cross-sectional shape in some embodiments. In other embodiments, bobbin tube 30 includes other suitable non-circular cross-sectional shapes such as rectangular, or other curvilinear or polygonal shapes. Each core half 12 includes a middle core leg 52 shaped to be partially received in axial passage 22 on bobbin tube 30. As further seen in FIG. 1 and FIG. 2, in some embodiments, each core half 12*a*, 12*b* includes first outer core legs 50*a*, 50*b* and second outer core legs 54*a*, 54*b*.

Bobbin tube 30 includes a plurality of axially spaced slots defined along the axial length of bobbin tube 30 in the direction of the axis of elongation 36. Each slot is generally configured to receive one or more winding inserts 16*a*, 16*b*, etc. Each winding insert may be installed in a substantially radial direction onto the bobbin tube 30 via one or more of the slots. In some embodiments, only one conductive winding insert is installed into each slot. In alternative embodiments, more than one conductive winding may be installed into each slot. The slots are arranged at pre-determined axial locations and may be substantially parallel to each other in some embodiments.

Referring now to FIG. 5, a partial top view of an embodiment of a bobbin 18 is generally illustrated. Bobbin 18 includes a first end wall 24 positioned at a first end of the bobbin tube 30 and a second end wall 26 positioned at a second end of the bobbin tube 30. Each end wall includes a radially-extending flange member that protrudes substantially radially outwardly from bobbin tube 30. A bobbin gap 34 is defined between the opposite end walls 24, 26. Bobbin gap 34 is generally shaped to accommodate one or more conductive windings or coils of a magnetic component. As seen in FIG. 5, and also in FIG. 9, bobbin 30 includes a plurality of slots 32, 42 defined along bobbin tube 30. In some embodiments, a plurality of first slots 32*a*, 32*b*, 32*c*, 32*d*, 32*e*, etc. are defined on the left side of bobbin tube 30, and a plurality of second opposing slots 42*a*, 42*b*, 42*c*, 42*d*, 42*e*, etc. are defined on the opposite side of bobbin tube. Each group of first and second opposing slots may be referred to as a slot pair. The number of slots defined in bobbin tube 30 generally relates to the number of winding inserts to be installed on the bobbin. In various embodiments, as few as one slot is defined on each opposing side of bobbin tube 30. In other embodiments, many more slots may be defined on each side of bobbin tube to accommodate more winding inserts.

As seen in FIG. 5, slots defined on opposing sides of bobbin tube 30 are generally axially aligned in some embodiments. For example, first left slot 32*a* is axially aligned with first right slot 42*a*. Left and right slots may alternatively be described as first and second opposing slots as they are positioned on opposite sides of the bobbin tube. Similarly, second left slot 32*b* is axially aligned with second right slot 42*b*. As such, a winding insert installed into each slot or opposing slot pair will be oriented substantially parallel to one or both bobbin end walls 24, 26. In other words, each slot may be described as being oriented transversely to the axis of elongation 36 in some embodiments.

Figure 3:
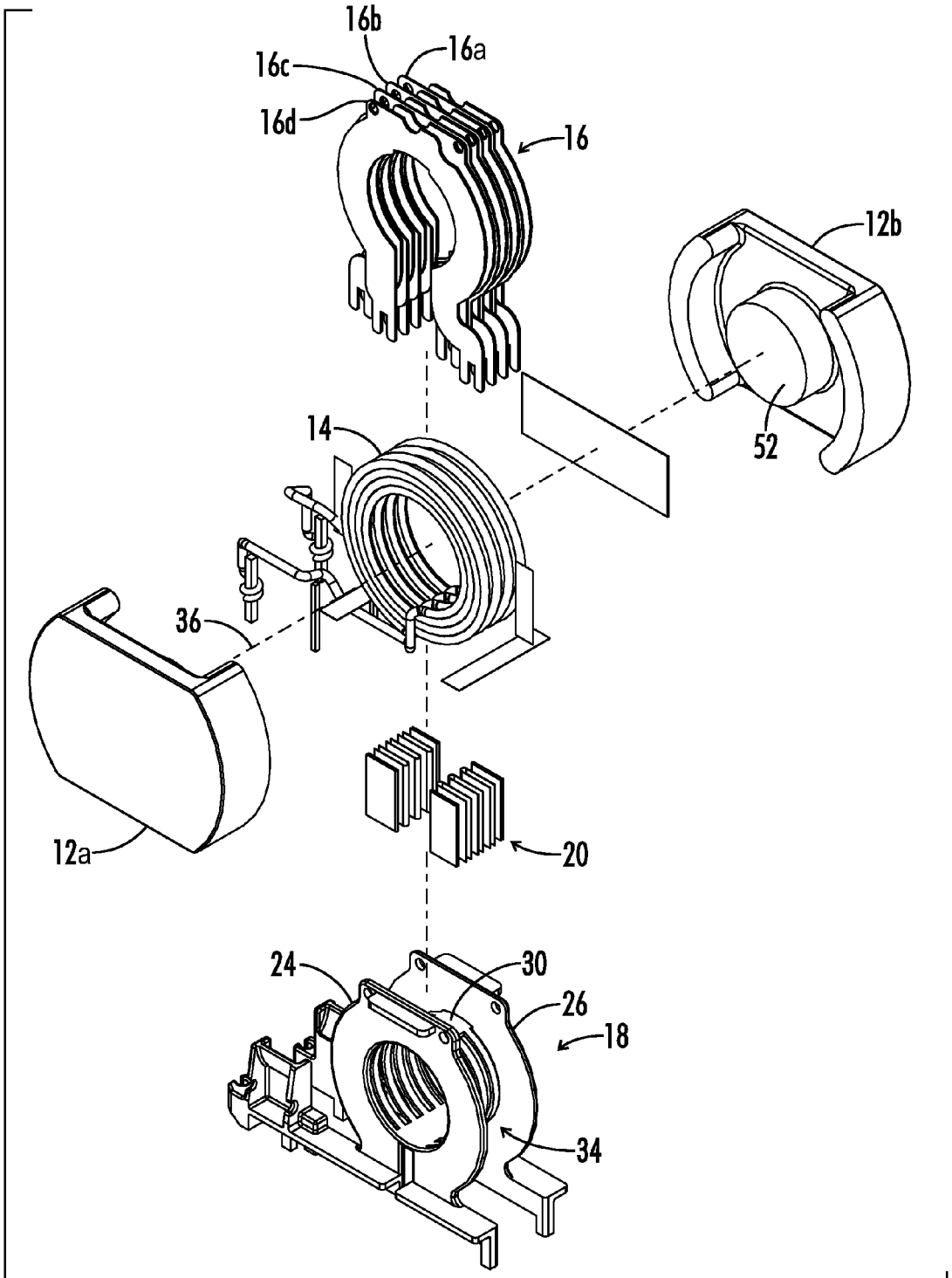
FIG. 3 illustrates an exploded view of the embodiment of a magnetic component of FIG. 1.

A winding assembly 16 is installed on the bobbin and is partially surrounded by core halves 12*a*, 12*b*. Winding assembly 16 includes a plurality of substantially flat or planar winding inserts 16*a*, 16*b*, 16*c*, 16*d*, etc. installed on bobbin 18, as seen in FIG. 3.

Figure 6:
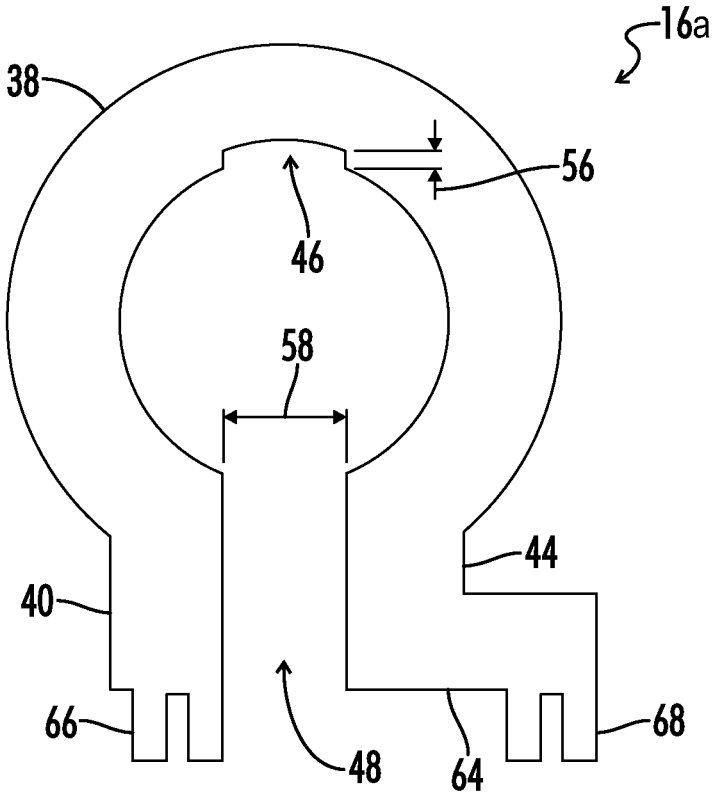
FIG. 6 illustrates an elevation view showing an embodiment of a winding insert.

Referring now to FIG. 6, an exemplary embodiment of a winding insert 16*a* is illustrated. Winding insert 16*a* includes a winding loop 38 forming an annular shape in some embodiments. Winding loop 38 may be semi-circular or may include a non-circular or rectangular shape in various embodiments. Winding loop 38 is interrupted by an insert opening 48 defined on the winding insert. Insert opening 48 provides a clearance opening allowing each winding insert 16*a*, 16*b*, etc. to be radially installed onto bobbin tube 30. Each winding insert 16*a*, 16*b*, etc. can be axially slid onto bobbin tube 30 via one or more corresponding slots 32, 42 at a pre-determined axial location on bobbin tube 30. This provides greater ease of assembly and greater precision in winding placement. Additionally, this allows windings with complex magnetic field interactions to be easily, quickly, and precisely assembled at lower cost than conventional winding configurations.

Figure 4:
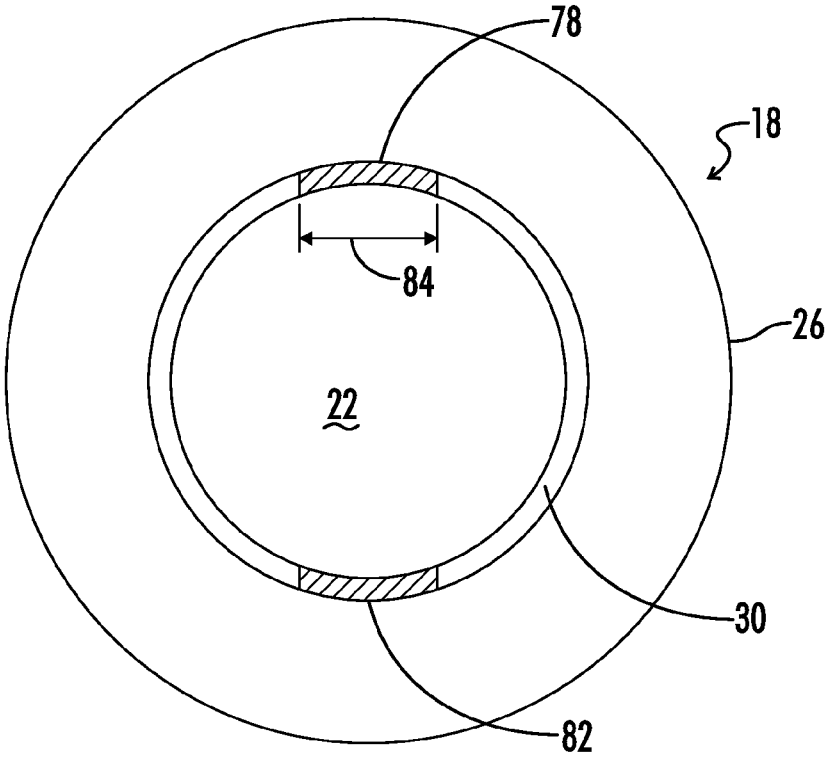
FIG. 4 illustrates a partial cross-sectional view of an embodiment of a bobbin showing Section 4-4 of FIG. 5.
Figure 8:
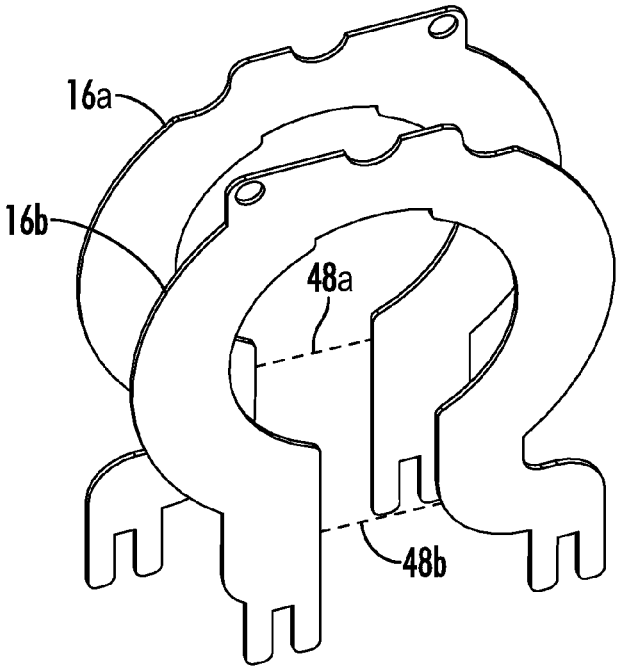
FIG. 8 illustrates a perspective view showing an embodiment of first and second winding inserts in accordance with the present invention.

Referring to FIG. 8 and FIG. 9, in some embodiments, adjacent winding inserts 16*a*, 16*b* may be installed into adjacent slots or adjacent slot pairs on the bobbin tube 30. For example, a first winding insert 16*a* is aligned with and radially installed into first right and first left slots 32*a*, 32*b*. Second winding insert 16*b* is aligned with and radially installed into second right and second left slots 32*b*, 42*b*. First winding insert 16*a* includes a first insert opening 48*a* that must have clearance over a portion of the bobbin tube 30 extending between first right and first left slots 32*a*, 42*a* to allow the first winding insert 16*a* to be slid onto the bobbin structure. An upper bridge 78 extends along bobbin tube 30 between slots on the right side of bobbin tube 30 and the slots on the left side of bobbin 30. Upper bridge 78 forms a structural connection on bobbin tube 30 spanning from first end wall 24 to second end wall 26. More particularly, upper bridge 78 extends between the upper end of the first right slot 32*a* and the upper end of first right slot 42*a*. Each insert opening 48 must be dimensioned to allow each winding insert 16*a*, 16*b*, etc. to pass without substantial interference. As seen in FIG. 6, winding insert 16*a* includes an insert opening width 58 defining the minimum width across insert opening 48. In some embodiments, first and second insert legs 40, 44 protrude away from winding loop 38, and insert opening 48 is defined between first and second insert legs. As seen in FIG. 4, upper bridge 78 defines an upper bridge width 84. In some embodiments, insert opening width 58 is no less than upper bridge width 84. Additionally, in some applications, each winding insert must pass over lower bridge 82. As such, insert opening width 58 is also no less than the width of lower bridge 82. Similarly, second winding insert 16*b* includes a second insert opening 48*b* that also must have clearance over upper and lower bridge 78, 82.

Also seen in FIG. 6, each winding insert 16 in some embodiments includes a tube notch 46, or recess, defined on the interior of the winding loop. Tube notch 46 is defined at a location corresponding to upper bridge 78, and generally includes a tube notch depth 56 dimensioned to accommodate upper bridge 78 when the winding insert is installed on bobbin tube 30. As such, tube notch 46 provides an angular lock that may prevent the winding insert from becoming inadvertently angularly misaligned in some applications or during assembly.

Figure 7:
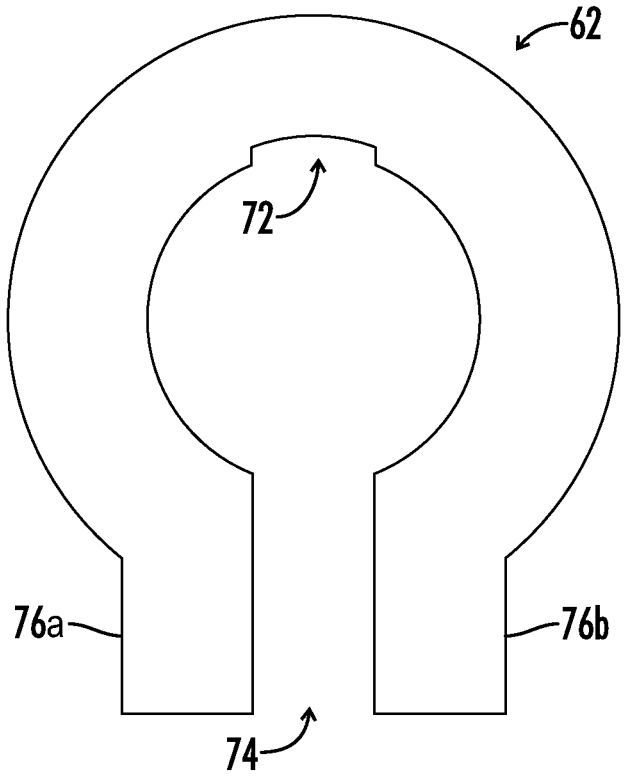
FIG. 7 illustrates an elevation view showing an embodiment of a spacer disk.
Figure 10:
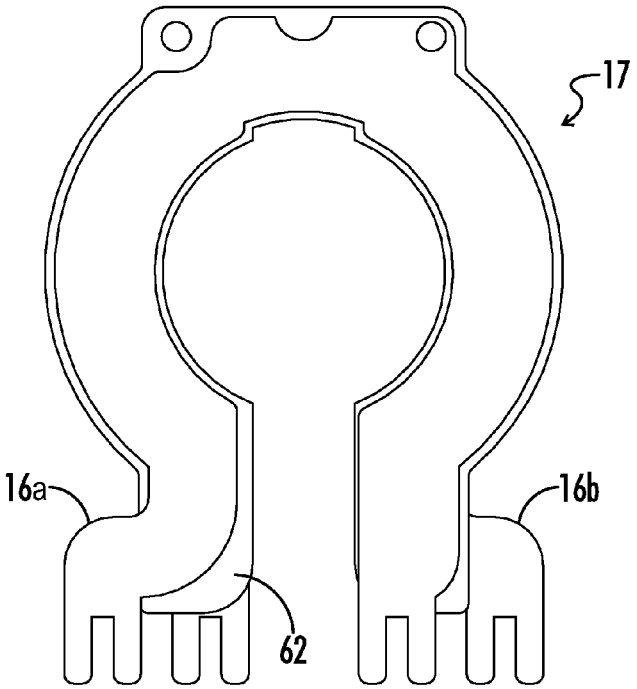
FIG. 10 illustrates an elevation view of an embodiment of a composite winding in accordance with the present invention.
Figure 11:
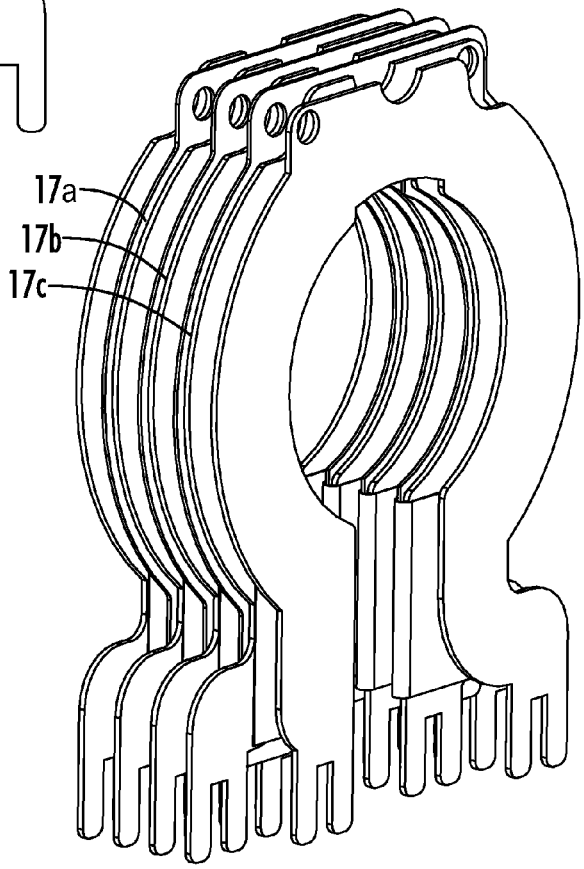
FIG. 11 illustrates a perspective view of an embodiment of a plurality of composite windings for installation on a bobbin in accordance with the present invention.

In some applications, the present invention provides multiple planar winding sheets installed in one slot or slot pair. For example, as seen in FIG. 10, a composite winding insert 17 includes first and second winding inserts 16*a*, 16*b* positioned adjacent one another for insertion into one slot or slot pair. Because each winding insert 16*a*, 16*b* includes a conductive material, it may be necessary to provide an electrically insulating spacer disk 62, as seen in FIG. 7, between the adjacent inserts 16*a*, 16*b*. The spacer disk 62 is sandwiched between the adjacent inserts 16*a*, 16*b*. Spacer disk 62 includes a spacer opening 72 allowing clearance of upper and lower bridges 78, 82 and also a spacer notch 72 in some embodiments. Spacer disk 62 includes a non-conductive foil material in some embodiments. Additional electrically insulating spacers 20 may also be provided between various items in the winding assembly, as seen in FIG. 3.

The assembly of first and second winding inserts 16*a*, 16*b* along with spacer disk 62 located therebetween may be inserted into first right and first left slots 32*a*, 42*a* as a composite winding insert 17 seen in FIG. 10. In some embodiments, a plurality of composite winding inserts 17*a*, 17*b*, 17*c*, etc. each having more than one winding insert 16 are installed into adjacent slots or adjacent slot pairs on bobbin tube 30 in some embodiments.

Referring again to FIG. 6, in some embodiment, a winding insert 16*a* includes a first insert leg 40 and a second insert leg 44 having asymmetrical profiles. Second insert leg 44 includes an offset portion 64 that extends away from first insert leg 40. A plurality of first pins 66 protrude from first insert leg 40 for connection to a circuit on a circuit board, and a plurality of second pins 68 protrude from the offset portion 64 on second insert leg 44. As such, when a composite insert 17 is formed, as seen in FIG. 10, the adjacent pins on each side of the insert openings are not aligned. This allows the pins to be connected at different locations on the circuit board and allows more variations and combinations for interactions between windings. In other embodiments not shown, the winding inserts 16*a*, 16*b*, etc. may have symmetrical pin locations.

Figure 12:
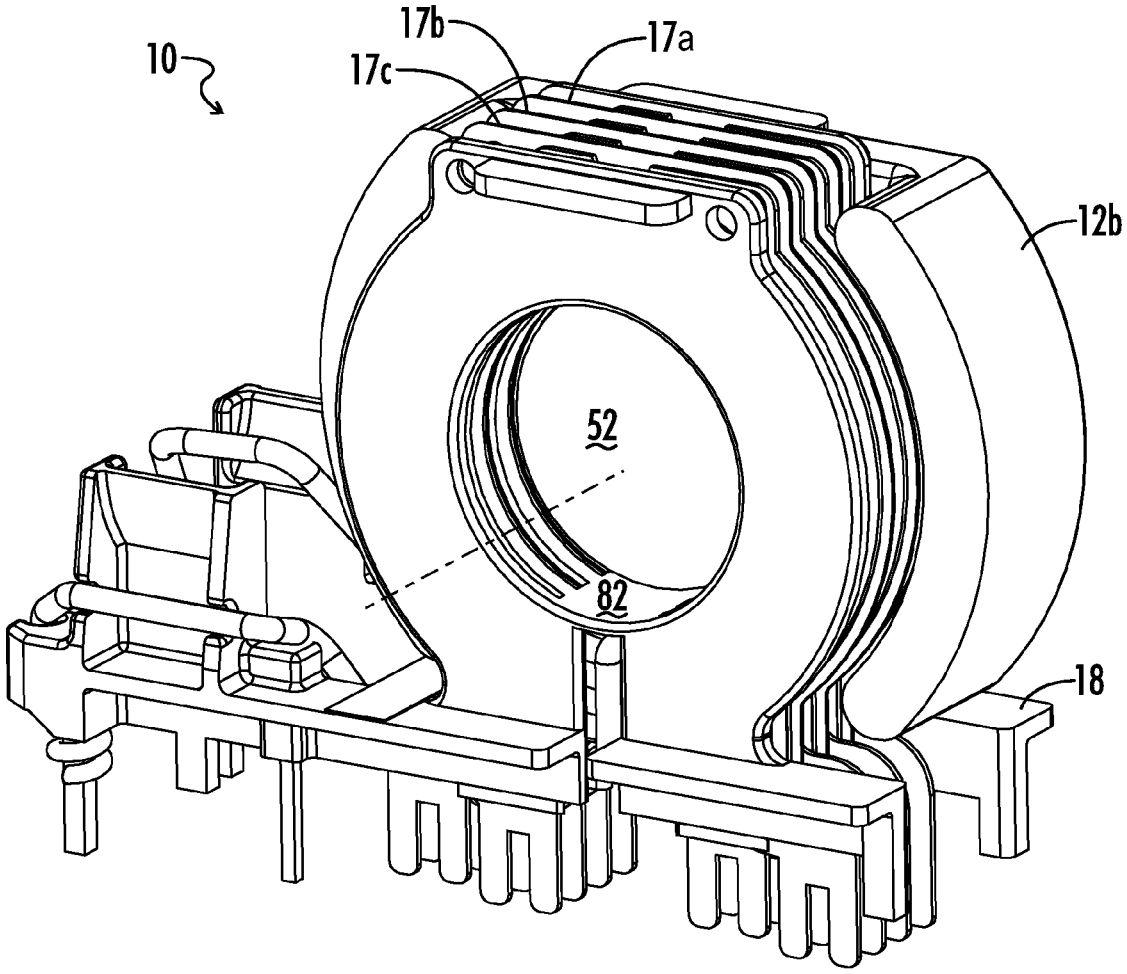
FIG. 12 illustrates a perspective view of an embodiment of a magnetic component in accordance with the present invention with one core half removed.

As seen in FIG. 12, first second and third composite winding inserts 17*a*, 17*b*, 17*c*, etc. may be installed on bobbin 18 to form a magnetic component 10.

Figure 13:
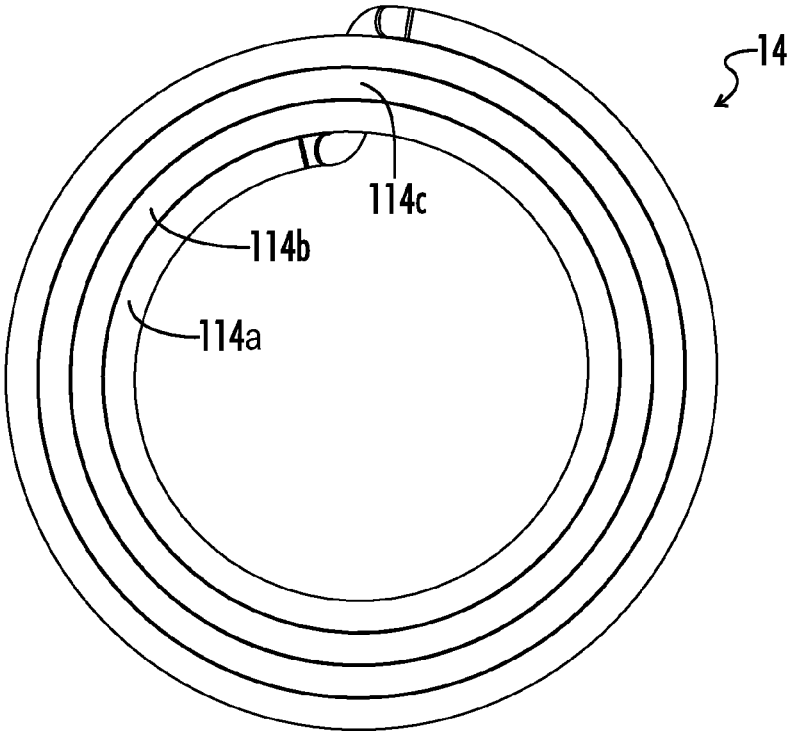
FIG. 13 illustrates an elevation view of an embodiment of a primary winding coil in accordance with the present invention.
Figure 14:
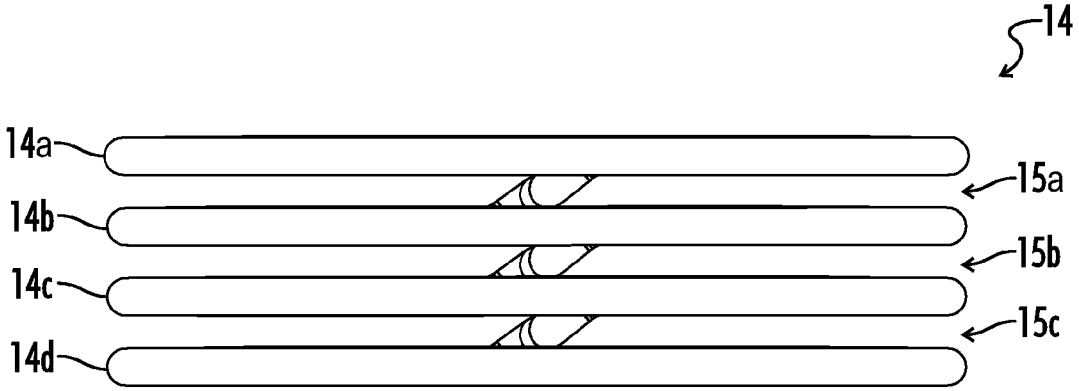
FIG. 14 illustrates a top view of an embodiment of a primary winding including multiple axially-spaced coils in accordance with the present invention.
Figure 15:
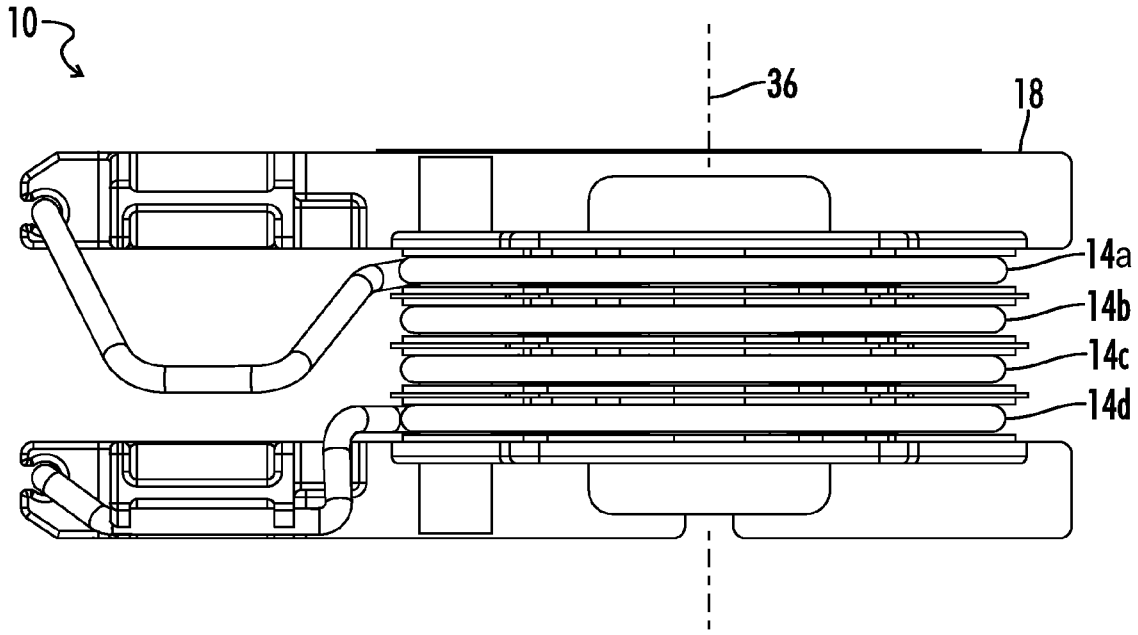
FIG. 15 illustrates a top view of an embodiment of a magnetic component with magnetic cores removed.

When either multiple unitary winding inserts 16*a*, 16*b*, 16*c*, etc. or composite winding inserts 17*a*, 17*b*, 17*c*, etc. are installed in axially-spaced slots on bobbin tube 30, voids are left between the adjacent inserts. In some embodiments, the present invention provides one or more primary conductive coils of wire disposed around the bobbin tube 30 in the spaces between adjacent winding inserts. For example, as seen in FIG. 13, a primary winding 14 having a plurality of turns of conductive wire may be disposed between adjacent inserts. Primary winding 14 includes a plurality of concentric and axially aligned turns 114*a*, 114*b*, 114*c*, etc. The multiple turns forms a substantially planar winding that can be disposed in the narrow gap between adjacent winding inserts. Primary winding 14 in some embodiments includes multiple parallel coils 14*a*, 14*b*, 14*c*, 14*d*, etc., wherein each coil is positioned between adjacent winding inserts or between a bobbin end wall and a winding insert. As seen in FIG. 14, each adjacent coil includes a coil gap 15*a*, 15*b*, 15*c*, etc. defined therebetween. Each coil gap is dimensioned to accommodate one or more winding inserts in the space between the adjacent coils, as seen in FIG. 15.

Figure 16:
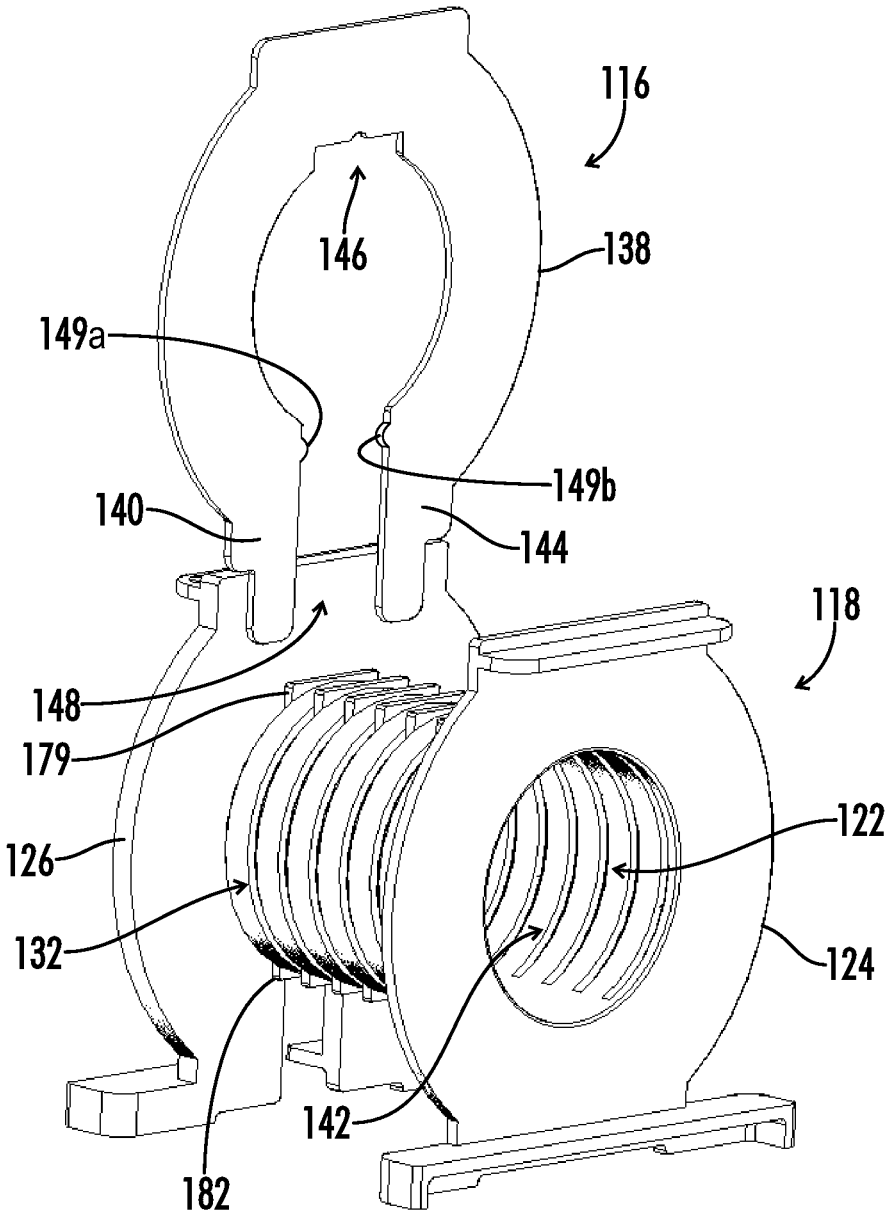
FIG. 16 illustrates a partially exploded perspective view of an embodiment of a bobbin and a winding insert for a magnetic component.
Figure 17:
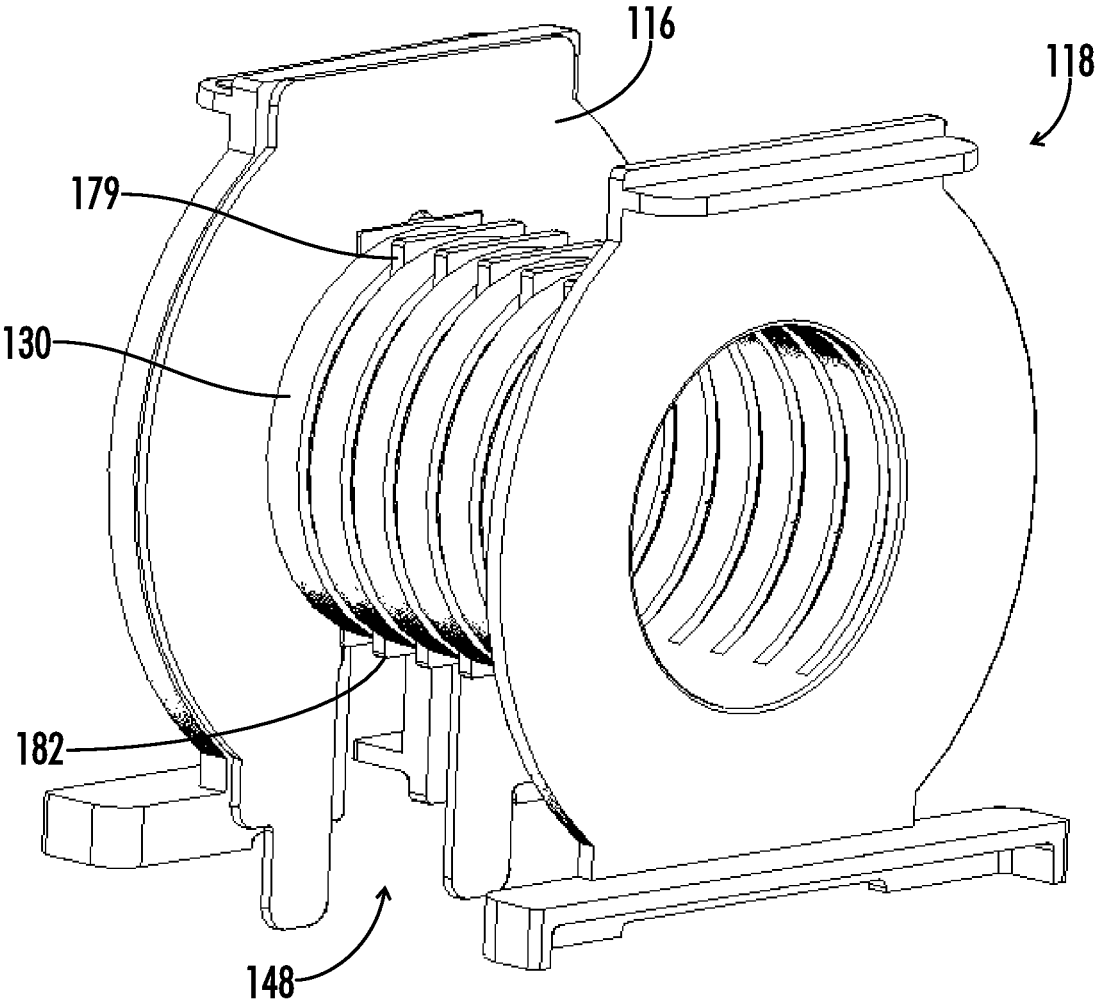
FIG. 17 illustrates a perspective view of the embodiment of a bobbin and winding insert of FIG. 16.

Referring now to FIGS. 16-29, additional embodiments of a slotted bobbin magnetic component device are illustrated. As seen in FIG. 16, a magnetic component device includes a bobbin 118 and at least one winding insert 116. Winding insert 116 includes a substantially planar electrically conductive sheet having an insert opening 148 defined between first and second insert legs 140, 144. Insert opening 148 is dimensioned to allow winding insert 116 to be radially installed on bobbin 118 by locating first insert leg 140 through a first slot 132, and by locating second insert leg 144 through an opposing second slot 142. One or more winding inserts 116 may be installed in each slot, as seen in FIG. 17. An axial passage 122 is defined through a bobbin tube 130 extending between first and second end walls 124, 126 on bobbin 118.

Figure 18:
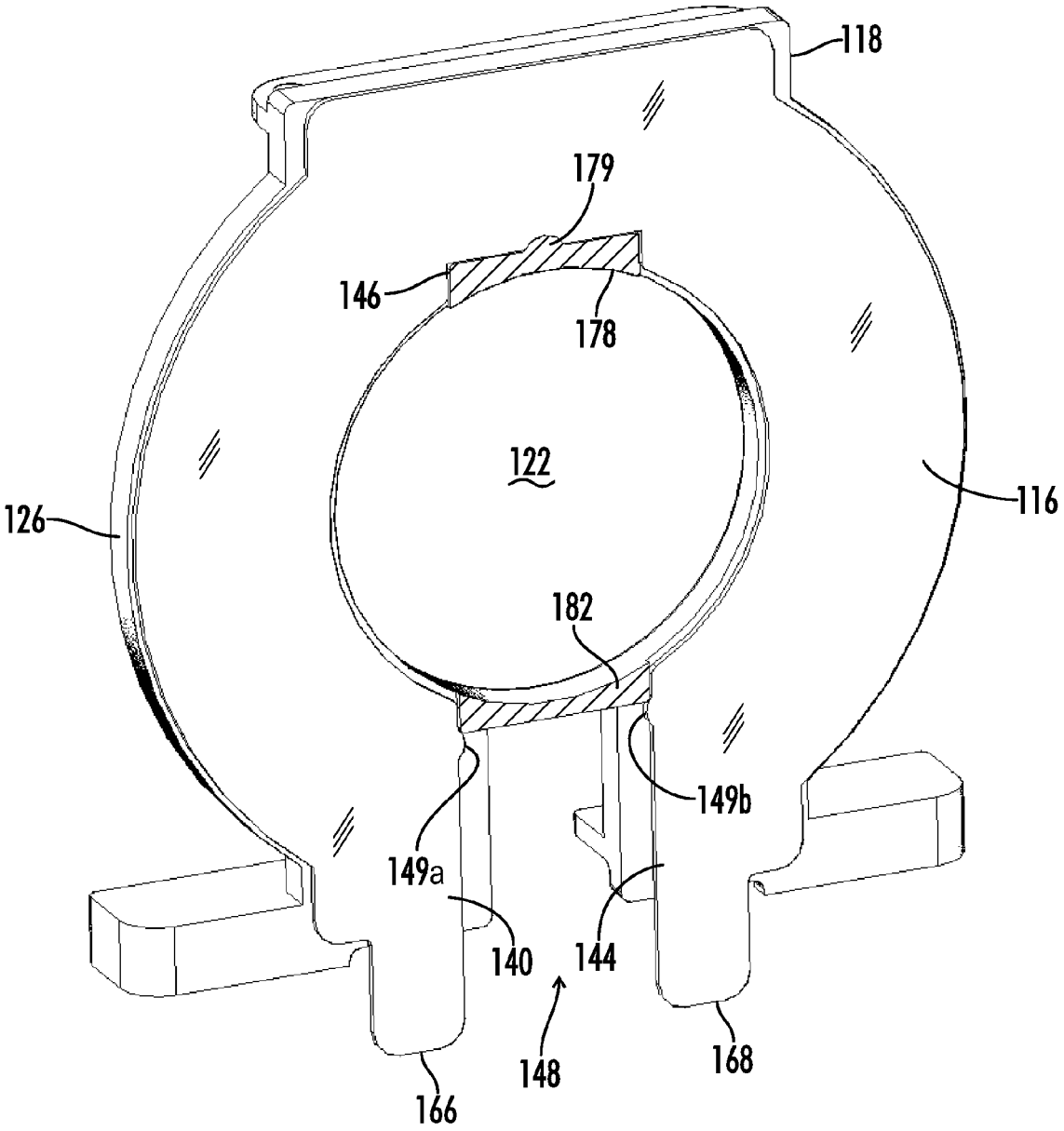
FIG. 18 illustrates a partial cross-sectional perspective view of an embodiment of a bobbin and winding insert for a magnetic component.

Referring to FIG. 18, in some embodiments, winding insert 116 includes one or more features aimed at retaining winding insert 116 radially, angularly, or both on bobbin 118. For example, once one or more winding inserts 116 are positioned on bobbin 118, a separate winding coil wire may be wound around bobbin 118 in the gaps between axially-spaced winding inserts 116. Winding placement or other movement of bobbin 118 may cause one or more winding inserts 116 to inadvertently become dislodged, misaligned, or fall out of bobbin 118. Such unintentional movement of winding insert 116 relative to bobbin 118 may cause damage to the winding and may result in a malfunctioning magnetic component.

As seen in FIGS. 16-18, upper bridge 178 on bobbin 118 includes an upper bridge flange 179 protruding upwardly from upper bridge 178. Upper bridge flange 179 is received in a corresponding notch 146, or recess, defined in winding insert 116. Upper bridge flange 178 extends upwardly from the bobbin tube 130, or the cylindrical portion of the bobbin 118 extending between first and second end walls 124, 126. Upper bridge flange 178 includes a substantially rectangular upper profile in some embodiments, as seen in FIG. 18. In alternative embodiments, upper bridge flange 179 may include any suitable polygonal or curvilinear shape. A separate upper bridge flange 179 is located between each pair of first and second slots in some embodiments. When seated in tube notch 146, upper bridge flange 179 provides a radial stop for winding insert 116 on bobbin 118, preventing winding insert 116 from advancing too far into the slots on bobbin tube 130. Upper bridge flange 179 is also received in tube notch 146 and provides an angular stop for winding insert 116, preventing winding insert 116 from angularly rotating relative to bobbin tube 130 on bobbin 118.

Figure 19:
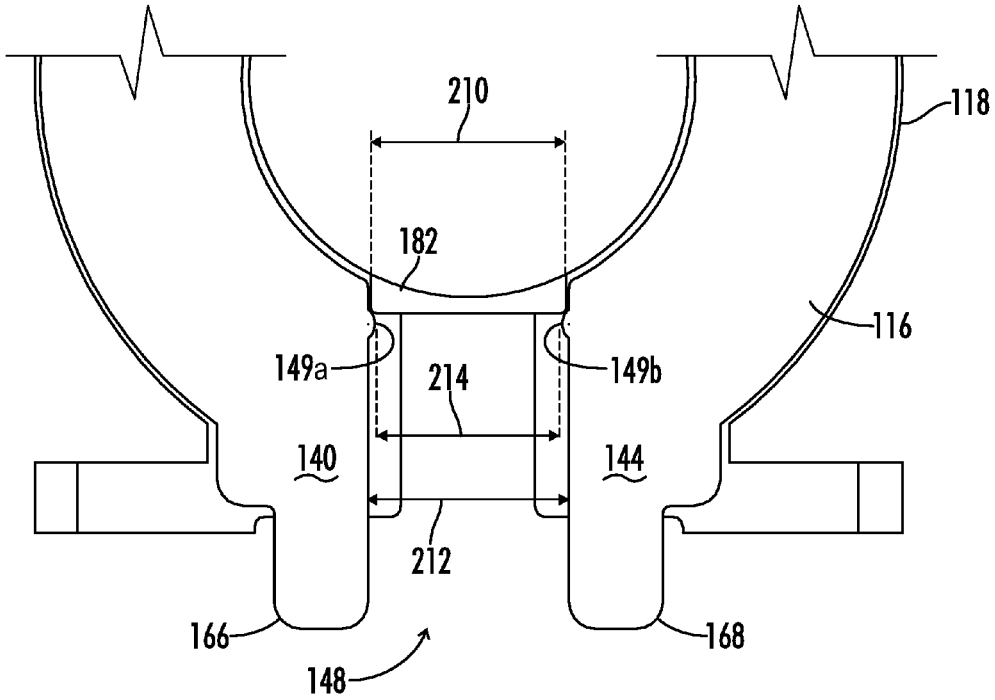
FIG. 19 illustrates a detail cross-sectional view of an embodiment of a winding insert installed on a bobbin for a magnetic component.
Figure 20:
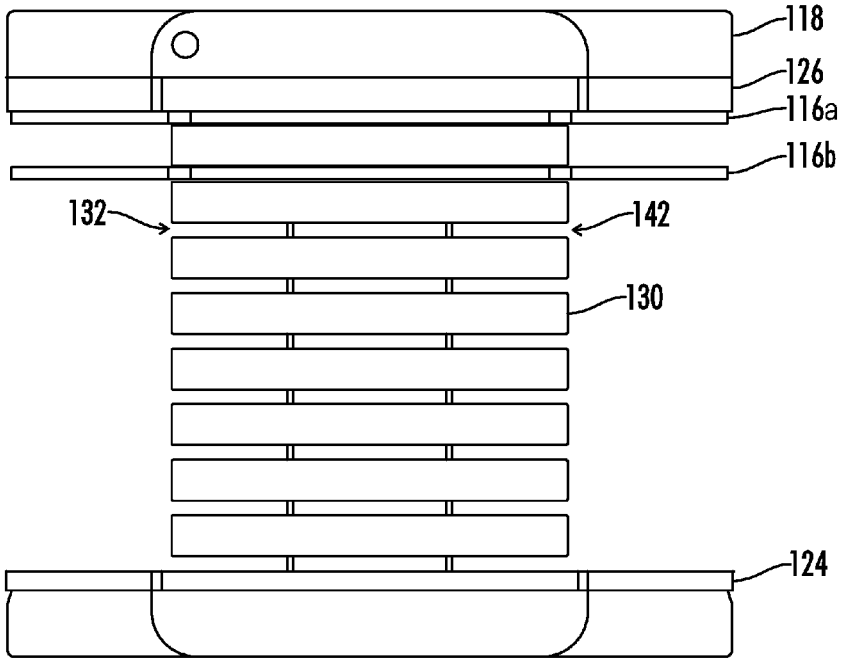
FIG. 20 illustrates a top view of an embodiment of a bobbin for a magnetic component with first and second winding inserts installed.

Referring further to FIGS. 18 and 19, in some embodiments, an additional feature to prevent movement of winding insert 116 is located on winding insert 116. A first detent 149*a* protrudes from first insert leg 140*a* toward insert opening 148. First detent 149*a* provides a small structural protrusion that extends from winding insert 116 below lower bridge 182 when winding insert 116 is installed on bobbin 118. First detent 149*a* is operable to prevent winding insert 116 from sliding radially from bobbin 118 during handling or winding operations. Similarly, a second detent 149*b* protrudes from second insert leg 140*b* toward insert opening 148. Second detent 149*b* is located opposite first detent 149*a* such that the first and second detents 149*a*, 149*b* both engage lower bridge 182 to prevent winding insert 116 from sliding radially from bobbin 118.

Referring further to FIGS. 18 and 19, lower bridge 182 includes a lower bridge flange protruding downwardly from bobbin tube 130 in some embodiments. The lower bridge flange includes a substantially rectangular configuration in some embodiments. In additional embodiments, lower bridge flange includes other suitable curvilinear or polygonal shapes. First and second detents 149*a*, 149*b* protrude from winding insert 116 generally below the lower bridge 182. Alternatively, first and second detents 149*a*, 149*b* engage corresponding recesses in lower bridge 182 to prevent winding insert 116 from inadvertently sliding radially from bobbin 118.

Referring further to FIG. 19, in some embodiments winding insert 116 includes first and second insert legs 140, 144 defining an insert opening 148 therebetween. Insert opening 148 includes an insert opening width 212 defining the interior gap spacing between the first and second insert legs 140, 144. Additionally, lower bridge 182 defines a lower bridge width 210. Insert opening width 212 is generally dimensioned to allow first and second insert legs 140, 144 to pass over the sides of lower bridge 182 during installation of winding insert 116. In some embodiments, first and second detents 149*a*, 149*b* define a detent gap width 214 as the shortest distance between first and second detents 149*a*, 149*b* across insert opening 148. Detent gap width 214 is less than lower bridge width 210 in some embodiments. Winding insert 116 in some embodiments includes a resilient material such as stamped metal such that first and second insert legs 140, 144 resiliently flex outwardly when first and second detents 149*a*, 149*b* pass over lower bridge 182. First and second insert legs 140, 144 snap back toward each other once first and second detents 149*a*, 149*b* clear the underside of lower bridge 182, as seen in FIG. 19. In some embodiments, winding insert 116 and bobbin 118 define a detent interference ratio of detent gap width 214 divided by lower bridge width 210, wherein the detent interference ratio is less than one.

Figure 26:
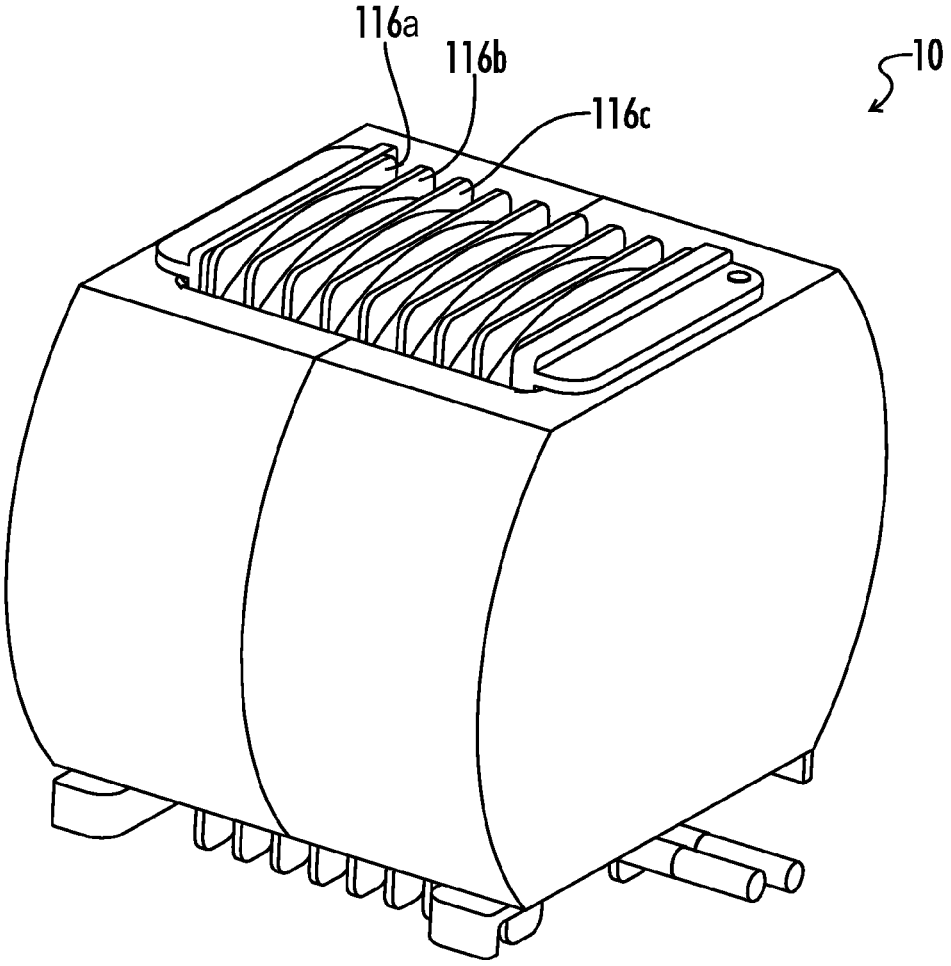
FIG. 26 illustrates a perspective view of an embodiment of an assembled slotted bobbin magnetic component device.

Bobbin 118 is generally configured to accept numerous winding inserts 116*a*, 116*b*, etc. at spaced axial positions between first and second end walls 124, 126 along bobbin tube 130, as seen in FIGS. 20-24. Each winding insert 116 may include a substantially flat or planar disk, such as a stamped copper disk, in some embodiments. Additionally, each winding insert 116 includes one or more adjacent spacer disks on one or both sides of each winding insert 116 in some embodiments, as seen in FIG. 26. Each spacer disk generally includes an electrical insulator material and may be used as a shielding or insulating spacer. Each spacer disk may also include first and second detents on spacer legs. Additionally, each spacer disk may include a recess shaped to receive upper bridge flange 179 in some embodiments.

Figure 21:
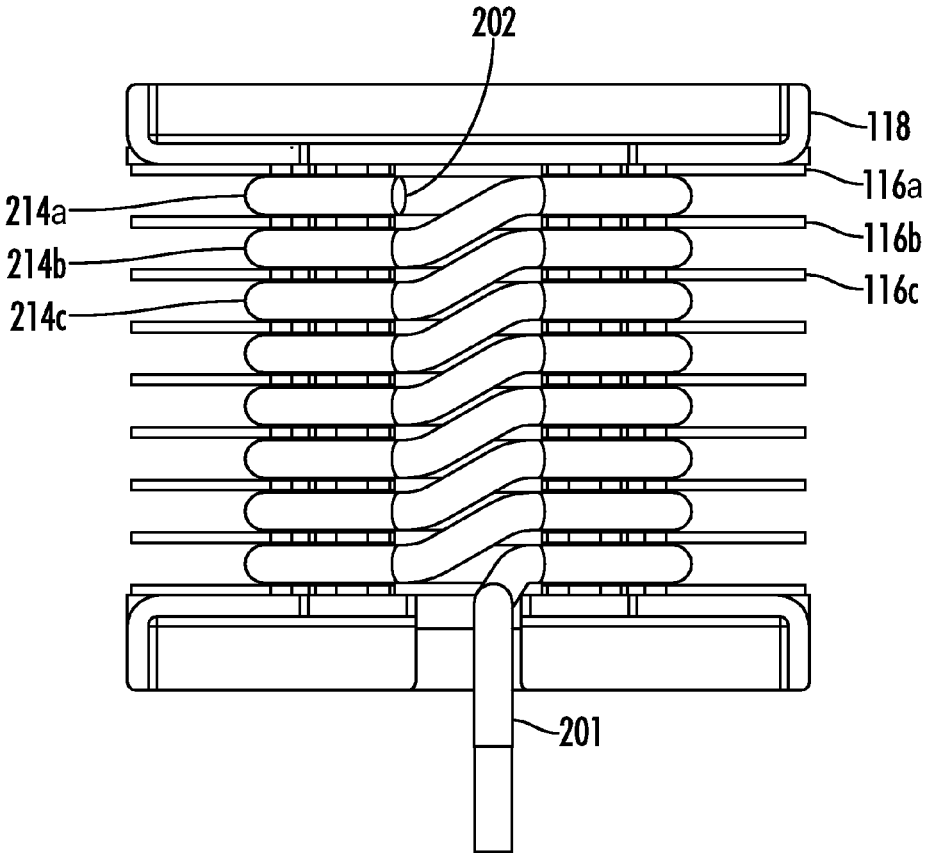
FIG. 21 illustrates a top view of an embodiment of a magnetic component with first winding coil layer positioned between winding inserts.
Figure 22:
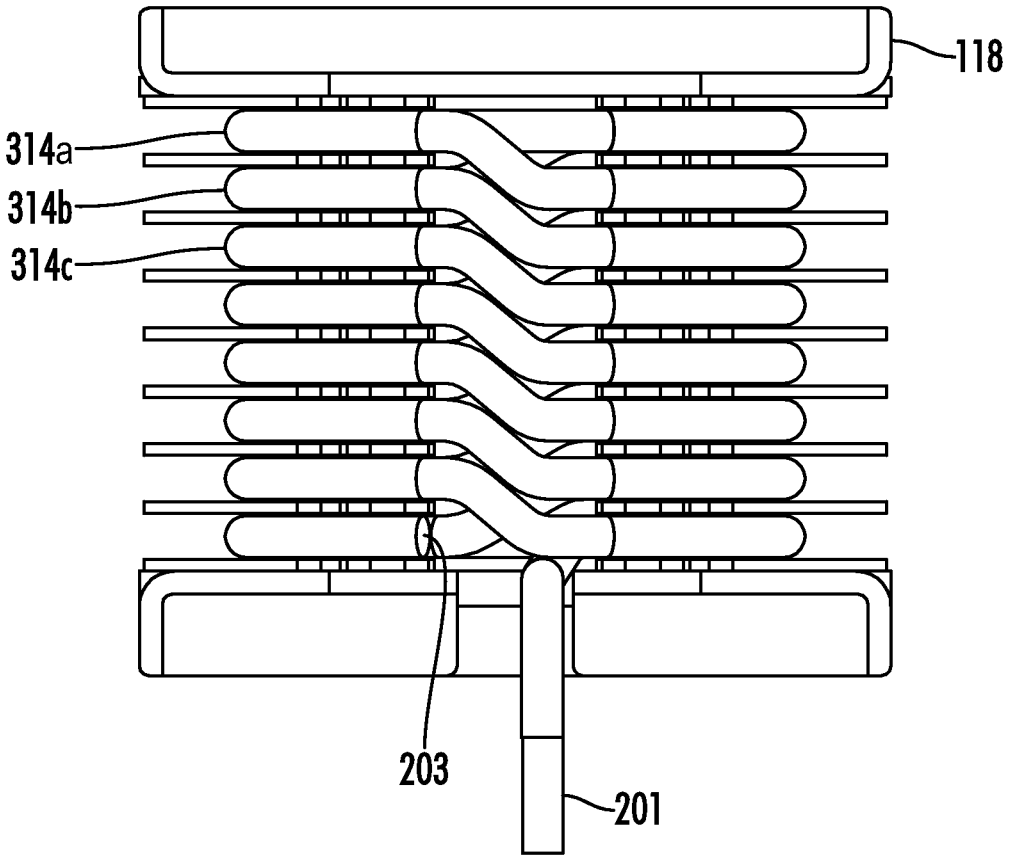
FIG. 22 illustrates a top view of the embodiment of a magnetic component of FIG. 21 with a second winding coil layer positioned over the first winding coil layer between winding inserts.
Figure 23:
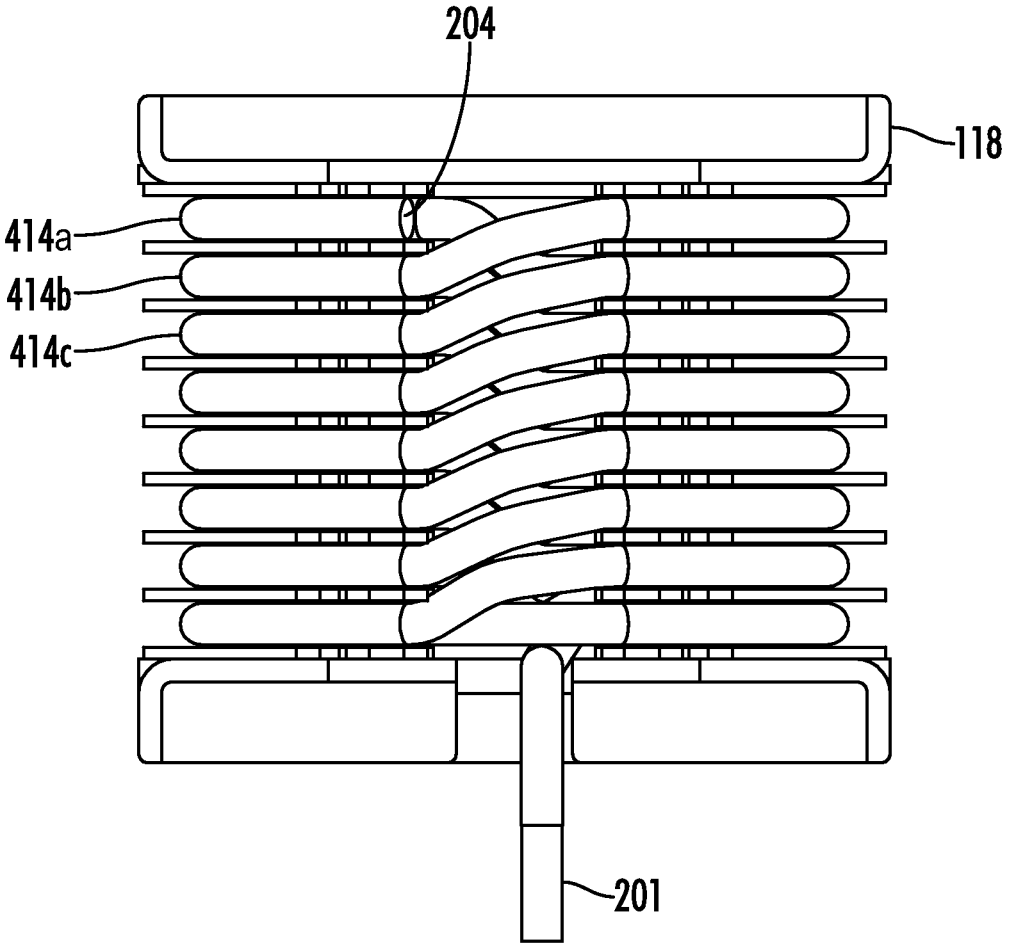
FIG. 23 illustrates a top view of the embodiment of a magnetic component of FIG. 22 with a third winding coil layer positioned over the first and second winding coil layers between winding inserts.
Figure 24:
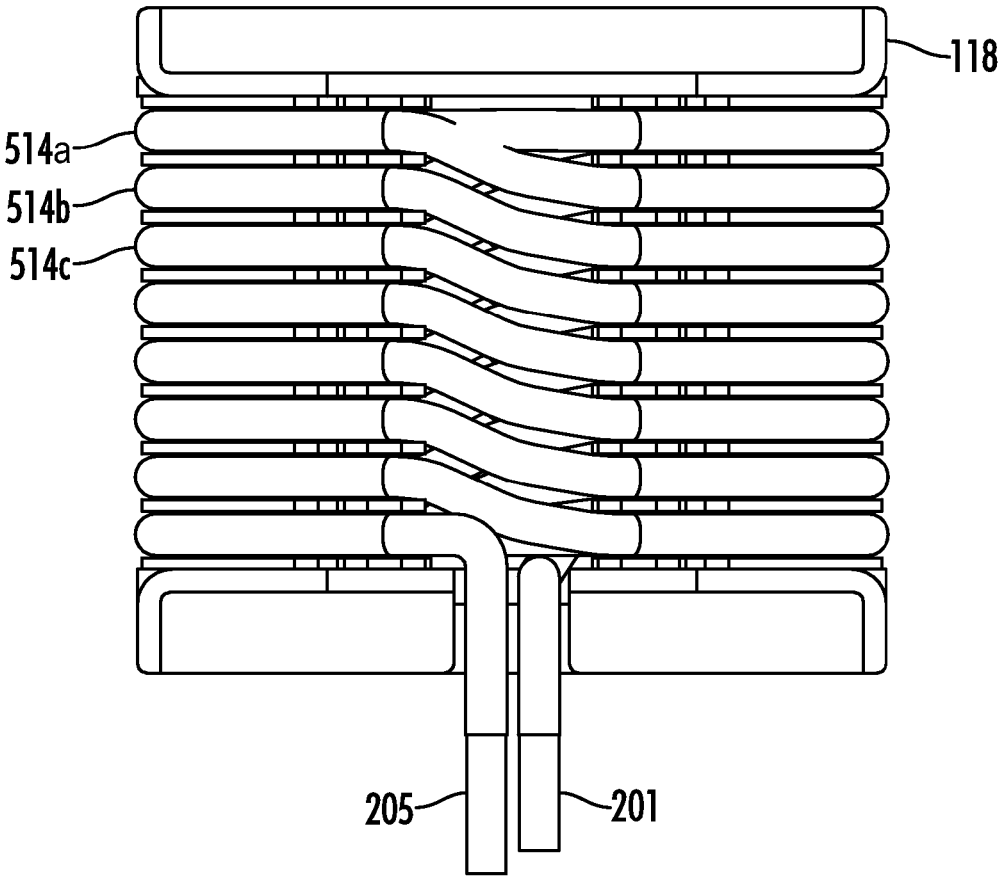
FIG. 24 illustrates a top view of the embodiment of a magnetic component of FIG. 23 with a fourth winding coil layer positioned over the first, second and third winding coil layers between winding inserts.

Another feature of the present invention is a winding configuration for positioning one or more winding coils on the bobbin between winding inserts. A slotted bobbin magnetic component in some embodiments includes two types of windings, including both planar winding inserts 116 and one or more winding coils 114. The winding coil 114 has numerous turns of conductive wire positioned around the bobbin tube in the gaps between winding inserts 116. The winding coil 114 may pass axially between neighboring gaps through the insert opening 148 between first and second insert legs 140, 144. At each axial gap location between neighboring winding inserts 116, the winding coil includes one or more layers, or turns, of wire. For example, at a first axial gap location between first and second winding inserts, the winding coil includes a first turn 114*a*, a second turn 114*b* positioned radially over the first turn, and a third turn 114*c* positioned radially over the second turn. In a first embodiment, for example as seen in FIGS. 13 and 14, all turns for a single coil position are wound in a single gap before the coil winding wire passes axially to the next vacant gap between subsequent winding inserts. However, in an alternative winding configuration, as seen in FIGS. 21-24, the winding coils are formed in a different manner. In this alternative configuration, a first coil layer is formed serially in each vacant gap between winding inserts, as seen in FIG. 21. The winding coil wire begins at a starting end 201 and proceeds to be wound around the bobbin tube between neighboring winding inserts 116*a*, 116*b*, 116*c*, etc. forming numerous first layer winding coils 214*a*, 214*b*, 214*c*, etc. at multiple axial locations. Each first layer winding coil 214 includes a single turn of winding coil wire around the bobbin 118 at that gap location. After winding the first layer, the first tag end 202 of the winding coil wire is then wound over each of the first layer winding coils 214 in the reverse axial winding direction, forming second layer winding coils 314*a*, 314*b*, 314*c* positioned radially over the first layer winding coils. After winding the second layer winding coils 314, the second tag end 203 is then wound over each of the second layer winding coils 314 in the reverse axial winding direction, forming third layer winding coils 414*a*, 414*b*, 414*c* positioned radially over the second layer winding coils, as seen in FIG. 23. The third tag end 204 is then wound over each of the third layer winding coils 414 in the reverse axial winding direction back toward the starting end 201, forming fourth layer winding coils 514*a*, 514*b*, 514*c*, etc. positioned radially over the third layer winding coils, as seen in FIG. 24. The fourth layer winding coils terminate at finishing end 205. Starting end 201 and finishing end 205 may be connected to an electronic circuit for operating the winding coil 114.

The various detent features on winding insert 116 prevent winding insert 116 from becoming misplaced during the winding procedure, as well as during handling, shipment or other manipulation of the magnetic component device. Additionally, filling the adjacent axial gaps with turns in a first layer before winding each successive next layer after the first layer prevents excessive pressure in each gap. For example, when the second winding layer is wound over a previously-wound first layer, the adjacent gaps also include a first layer winding coil. As such, radial pressure exerted inwardly by the second layer winding may not cause the winding inserts to axially flex as much as they would if the adjacent gaps were empty. This configuration allows a greater winding tension and a tight winding arrangement as compared to other configurations that place numerous radial turns in a single gap before moving the winding coil wire to the next adjacent vacant gap.

Figure 25:
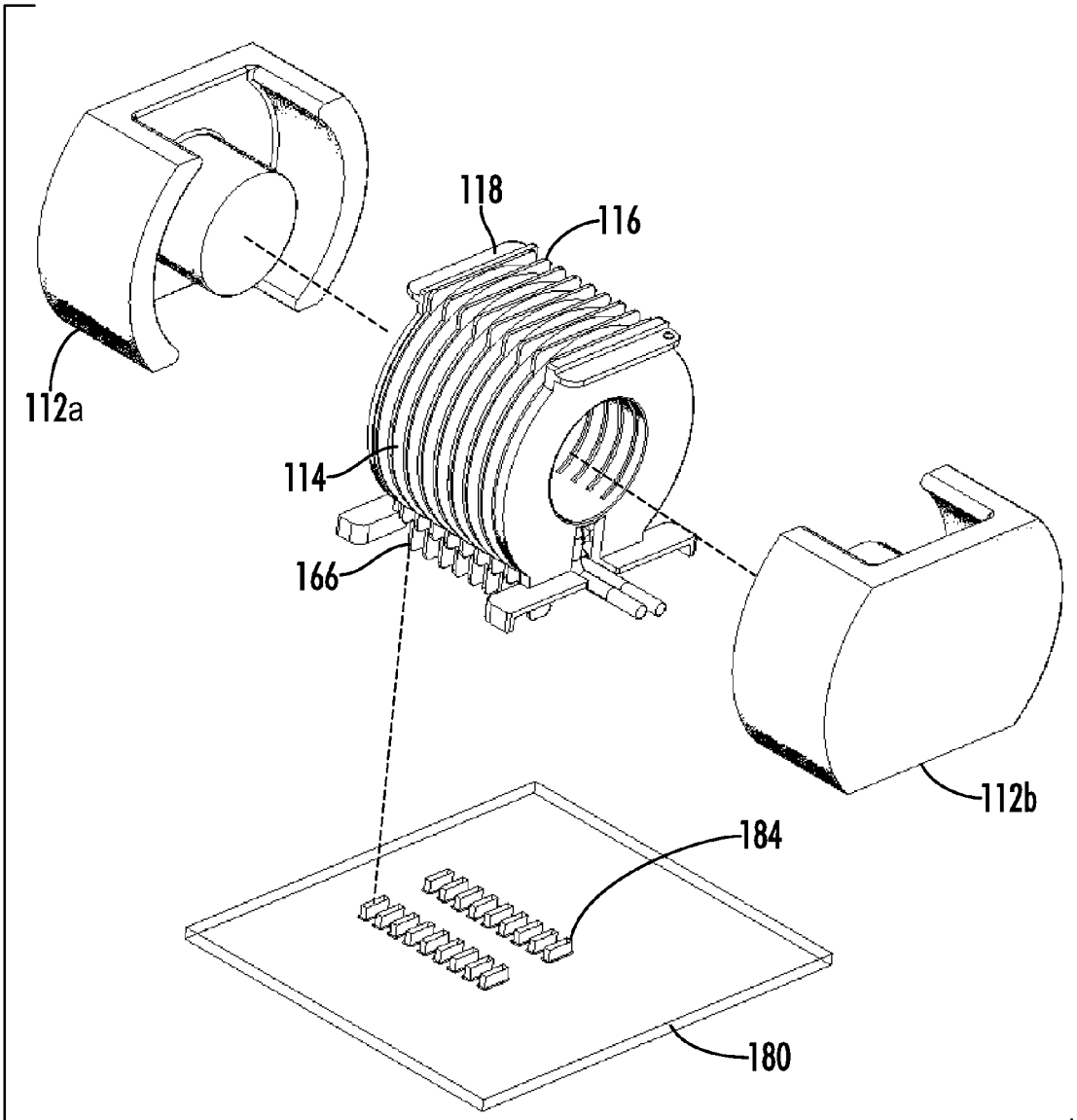
FIG. 25 illustrates an exploded perspective view of an embodiment of a slotted bobbin magnetic component device.

As seen in FIG. 25, once the winding inserts 116 and the winding coil 114 are positioned on the bobbin 118, the first and second core halves 112*a*, 112*b* are installed on the bobbin 118, and the assembly is mounted on a circuit board 180. In some embodiments, each winding insert 116 includes one or more terminal pins 166, 168 protruding downwardly below bobbin 118. Each terminal pin is received in, or otherwise engages, a corresponding electrical terminal connector on circuit board 180. Each terminal connector may include a terminal socket or terminal via defined in the circuit board. For example, first and second terminal pins 166, 168 may protrude downwardly from a winding insert 116 on bobbin 118 and engage corresponding terminal connectors. The terminal pins on each winding insert may be connected in series or in parallel. The connection configuration is generally established by printed traces or other electrical connections on the circuit board 180. Referring to FIG. 26, an assembled magnetic component device includes a plurality of winding inserts 116*a*, 116*b*, 116*c* mounted on bobbin 118 between the first and second core halves. The magnetic component device may be installed on a printed circuit board after assembly.

In further embodiments, the present invention provides a method of assembling a magnetic component for an electronic circuit. The method includes the steps of (a) providing a bobbin having a plurality of axially-spaced transverse slots; and (b) radially inserting one or more substantially flat winding inserts into each transverse slot. The method may also include the steps of installing a conductive winding coil into a space between adjacent winding inserts.

Thus, although there have been described particular embodiments of the present invention of new and useful slotted bobbin magnetic component devices and methods, it is not intended for such references to be construed as limitations upon the scope of the invention except as set forth in the following Claims.

What is claimed is:

1. A magnetic component for an electronic circuit, comprising:

a bobbin having an elongated bobbin tube with first and second ends;

a first bobbin end wall disposed at the first end of the bobbin tube;

a second bobbin end wall disposed at the second end of the bobbin tube;

a first transverse slot disposed on a first side of the tube, the first slot defining a first semi-circumferential opening in the bobbin tube;

a second transverse slot disposed on a second side of the tube opposite the first transverse slot, the second slot defining a second semi-circumferential opening in the bobbin tube;

a first substantially planar winding insert positioned on the bobbin tube at least partially in the first and second transverse slots at an axial location on the bobbin tube between the first and second bobbin end walls; and a first detent positioned on the winding insert, the first detent positioned to radially secure the winding insert on the bobbin.

2. The apparatus of claim 1, further comprising:

a flange protruding from the bobbin; and a recess defined in the winding insert shaped to receive the flange, the flange positioned to prevent angular movement of the winding insert relative to the bobbin when the flange is received in the recess.

3. The apparatus of claim 2, further comprising a second detent positioned on the winding insert opposite the first detent, the second detent positioned to radially secure the winding insert on the bobbin.

4. The apparatus of claim 3, further comprising:

a bridge defined on the bobbin tube between the first and second slots, the bridge having a bridge width.

5. The apparatus of claim 4, further comprising the first and second detents spaced apart by a detent gap width, wherein the detent gap width is less than the bridge width.

6. The apparatus of claim 3, further comprising:

a second winding insert positioned on the bobbin axially spaced from the first winding insert; and a winding coil positioned on the bobbin between the first and second winding inserts.

7. The apparatus of claim 6, further comprising:

a third substantially planar winding insert positioned on the bobbin axially spaced from the first and second winding inserts; and the winding coil positioned on the bobbin extending between the second and third winding inserts.

8. The apparatus of claim 7, further comprising a first winding coil layer disposed around the bobbin between the first and second winding inserts and around the bobbin between the second and third winding inserts.

9. The apparatus of claim 8, further comprising a second winding coil layer positioned radially over the first winding coil layer between the first and second winding inserts and between the second and third winding inserts.

10. A slotted bobbin magnetic component apparatus, comprising:

an annular bobbin tube having first and second end walls;

a first plurality of transverse slots defined in a first side of the tube;

a second plurality of transverse slots defined in a second side of the tube, each one of the second plurality of transverse slots positioned opposite one of the first plurality of transverse slots;

a substantially planar winding insert installed on the bobbin at a first axial position, the first winding insert including first and second insert legs defining an insert opening between the first and second insert legs;

a first winding region defined on the bobbin tube on a first axial side of the winding insert;

a second winding region defined on the bobbin tube on a second axial side of the winding insert opposite the first axial side;

a first detent protruding from first insert leg into the insert opening;

a second detent protruding from the second insert leg into the insert opening positioned opposite the first detent, the first and second detents positioned to radially secure the winding insert on the bobbin; and a winding coil wound axially around the bobbin between the first and second winding regions, the winding coil extending through the insert opening to pass from the first winding region to the second winding region.

11. The slotted bobbin apparatus of claim 10, further comprising:

a bridge extending axially along the bobbin tube between the first and second bobbin end walls and spanning the first and second pluralities of transverse slots;

a recess defined in the winding insert; and a flange protruding from the bridge into the recess, the flange operable to angularly secure the winding insert relative to the bobbin and to provide a radial stop for the winding insert.

* * * * *